US007062996B2

(12) United States Patent
Johnson

(10) Patent No.: US 7,062,996 B2
(45) Date of Patent: Jun. 20, 2006

(54) AUTOMATICALLY ADJUSTING GRIPPING DEVICE

(76) Inventor: Robert L. Johnson, 3343 Windgate Dr., Buford, GA (US) 30519

( * ) Notice: Subject to any disclaimer, the term of this patent is extended or adjusted under 35 U.S.C. 154(b) by 27 days.

(21) Appl. No.: 10/970,466

(22) Filed: Oct. 22, 2004

(65) Prior Publication Data

US 2006/0086211 A1 Apr. 27, 2006

(51) Int. Cl.
*B25B 13/18* (2006.01)

(52) U.S. Cl. ..... 81/128; 81/129; 81/60; 81/155; 81/157; 81/158

(58) Field of Classification Search ..... 81/128, 81/129, 60, 155, 157, 158
See application file for complete search history.

(56) References Cited

U.S. PATENT DOCUMENTS

| | | | | |
|---|---|---|---|---|
| 2,580,247 | A | 12/1951 | Secondi | |
| 2,582,444 | A | 1/1952 | Lucht | |
| 2,764,050 | A | 9/1956 | Leibowitz | |
| 2,884,826 | A | 5/1959 | Bruhn | |
| 3,285,106 | A | 11/1966 | Svenson | |
| 4,676,125 | A | 6/1987 | Ardelean | |
| 5,207,129 | A * | 5/1993 | Fossella | 81/63.2 |
| D349,025 | S | 7/1994 | Romero | |
| 5,375,489 | A | 12/1994 | McClure | |
| 5,768,961 | A | 6/1998 | Frawley | |
| 5,819,607 | A | 10/1998 | Carnesi | |
| 5,918,511 | A | 7/1999 | Sabbaghian et al. | |
| 5,996,446 | A | 12/1999 | Lee | |
| 6,073,522 | A * | 6/2000 | Carnesi | 81/128 |
| 6,467,379 | B1 | 10/2002 | Wizman | |
| 6,622,598 | B1 | 9/2003 | Chang | |
| 6,662,689 | B1 | 12/2003 | Voskanyan | |

FOREIGN PATENT DOCUMENTS

| | | |
|---|---|---|
| EP | 246072 | 11/1987 |
| WO | WO 81/02540 | 9/1981 |
| WO | WO/87/07864 | 12/1987 |

* cited by examiner

*Primary Examiner*—Lee D. Wilson
*Assistant Examiner*—Shantese McDonald
(74) *Attorney, Agent, or Firm*—Richard C. Litman

(57) ABSTRACT

The automatically adjusting gripping device grips a workpiece ever more tightly as greater torque is applied thereto. The device has a base plate having a linear guide slot or series of radial guide slots, with a pair of jaws residing in each slot. A torque application component rotates relative to the base plate, and has a cam track of varying diameter in which the heads of the jaws ride. Rotation of the torque application component and cam track relative to the base plate causes the jaw heads to slide along the track due to the jaws being captured within the base plate slot, thereby changing the span between jaws as the cam track diameter varies at the jaw head locations. The gripping device is useful as an adjustable wrench but may be applied to other environments as well, e.g., as an automatic gripping and releasing device in conveyor systems, etc.

18 Claims, 10 Drawing Sheets

AUTOMATICALLY ADJUSTING GRIPPING DEVICE

BACKGROUND OF THE INVENTION

1. Field of the Invention

The present invention relates generally to wrenches and similar mechanical devices having adjustable jaws. More particularly, the present invention comprises a gripping device having at least one pair of opposed jaws moving in a linear guide track with the separation of the jaws being driven by a cam track in a torque application component which rotates relative to the base plate.

2. Description of the Related Art

A single wrench or gripping tool having adjustably positionable jaws to grip various sizes or diameters of bolt heads, nuts, and other fittings has been a goal of the toolmaking industry for decades. Various devices have been developed in the past, with these devices having various degrees of success in industry and the marketplace.

A well-known example of such an adjustable tool is the Crescent® wrench, having one fixed jaw and a single, linearly adjustable jaw extending from the fixed jaw and handle. Due to the unitary, monolithic construction of the fixed jaw and handle, the device must be operated essentially like a conventional open-end wrench. A relative of such adjustable wrenches is the pipe wrench or "monkey wrench," which also has a linearly adjustable jaw opposite a fixed jaw and handle. The pipe wrench typically includes an intentionally large amount of play between the two jaws, which causes the movable jaw to be biased toward the fixed jaw and to grip the fastener head or fixture more tightly therebetween when torque is applied toward the movable jaw. Reversing the direction of pressure on the handle releases the grip, allowing the pipe wrench to be rotated about the workpiece to accomplish somewhat the same function as provided by a ratcheting wrench. However, the pipe wrench has sharp teeth of the gripping jaws, which may damage hexagonal nuts and other such fasteners, and the span of the jaws varies in steps, rather than continuously, due to use of a rack for adjustment of the span.

Many wrenches and gripping devices provide a ratcheting action, in which a ratchet may be swung arcuately back and forth with the ratchet releasing in one direction and gripping in the opposite direction to apply unidirectional rotational movement to the adjustable jaws. However, the present inventor is unaware of any devices which provide automatic adjustment of the jaw span as the attached ratchet or similar device is rotated, and which also provides a tighter grip on the workpiece between the jaws as more torque is applied to the ratchet handle with the simplicity and effectiveness of the gripping device of the present invention. Thus, an automatically adjusting gripping device solving the aforementioned problems is desired.

SUMMARY OF THE INVENTION

The automatically adjusting gripping device has a base plate having a plurality of adjustably positionable jaws depending therefrom, and a torque application component which is attached to the base plate and which rotates relative to the base plate. The base plate includes a generally diametric linear guide slot (for a two jaw embodiment) or series of radially disposed linear guide slots corresponding to the number of jaws, in which the jaws adjustably slide. The torque application component includes a cam track therein, in which the heads of the jaws ride or slide. The cam track varies in diameter relative to the concentric axes of the base and torque application components. Thus, rotation of the torque application component relative to the base plate results in the heads of the jaws being forced along the cam track of the torque application component, due to the jaws being captured within the slot(s) of the base plate. This results in the span of the jaws changing as the diameter of the cam track varies where the jaw heads are located, thus adjusting the jaws to fit a given workpiece as desired. Additional torque on the torque application component urges the jaw heads further along the cam track, thereby forcing them even more tightly against the workpiece.

The gripping device includes several embodiments, with the embodiments varying primarily according to the number of jaws, the configuration of the cam track, and the assembly of the torque application component to the base component. The gripping device is particularly useful in combination with a ratchet for installing and removing threaded fasteners, but may also be adapted for use as an automatic gripping and releasing device in conveyor systems and other environments where automatic gripping and releasing of an article or object is required.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
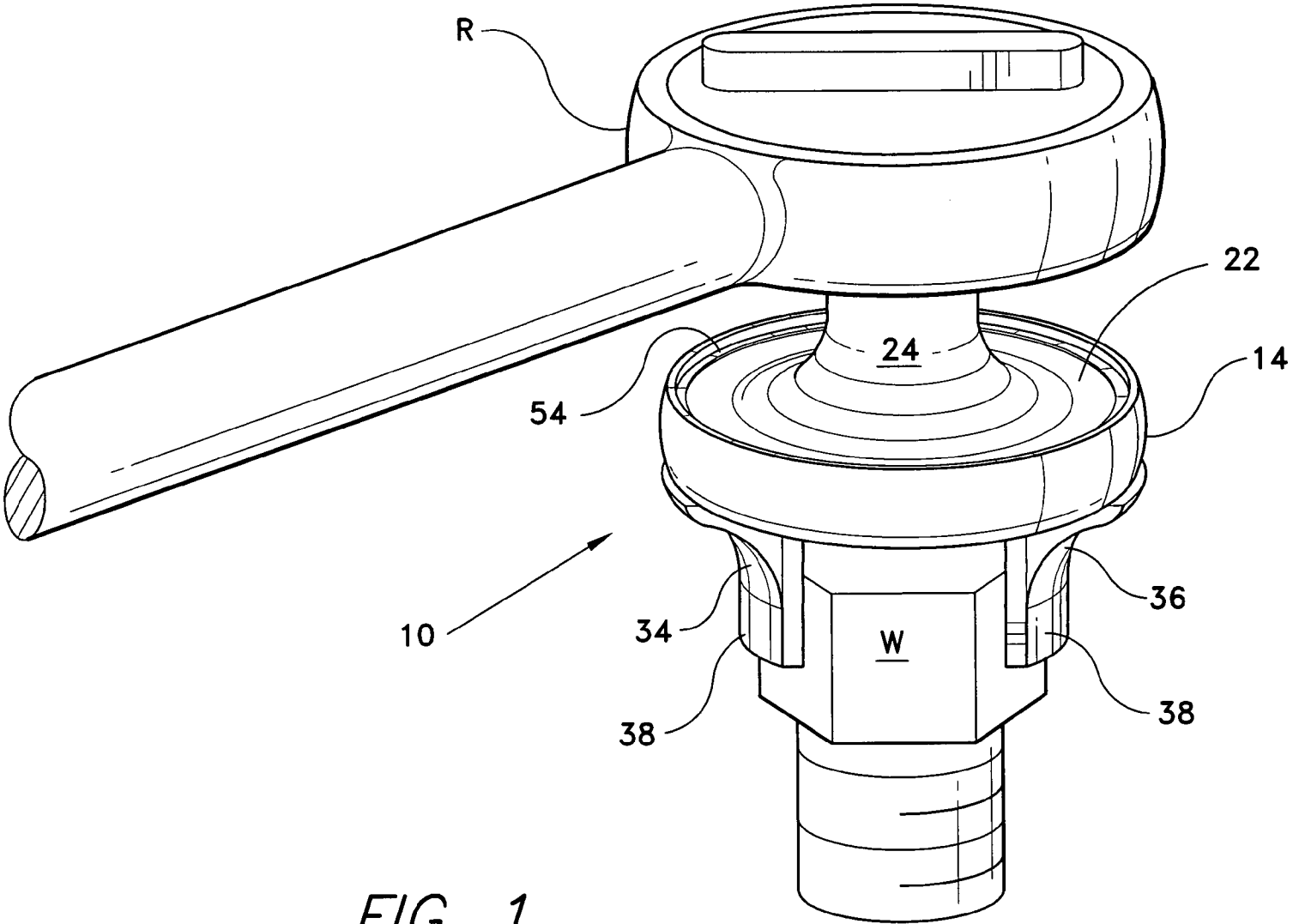
FIG. 1 is an environmental, perspective view of an automatically adjusting gripping device according to the present invention, showing its operation on a threaded fastener head.
Figure 2:
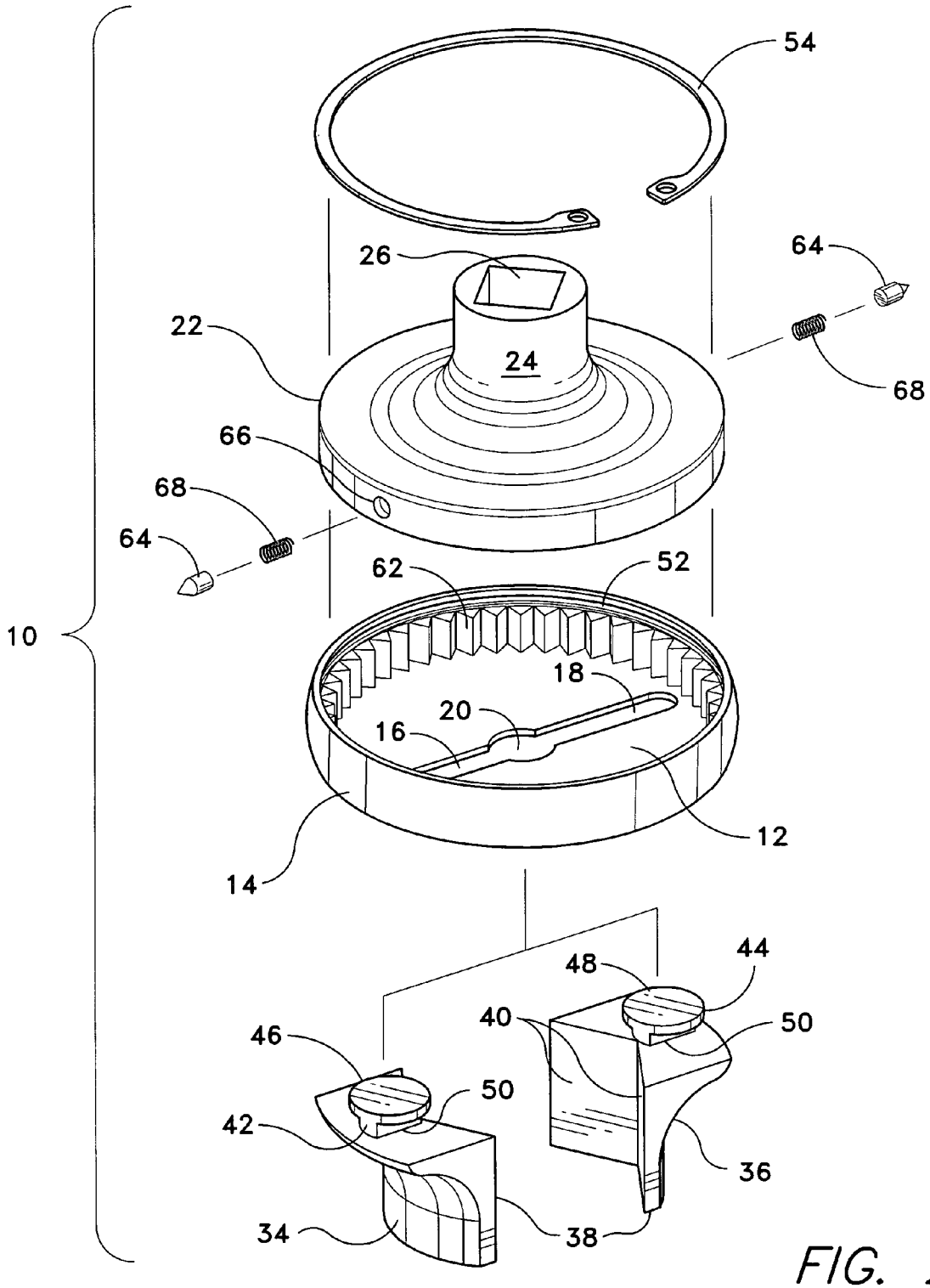
FIG. 2 is an exploded perspective view of the present gripping device, showing the relationship of the components.
Figure 3:
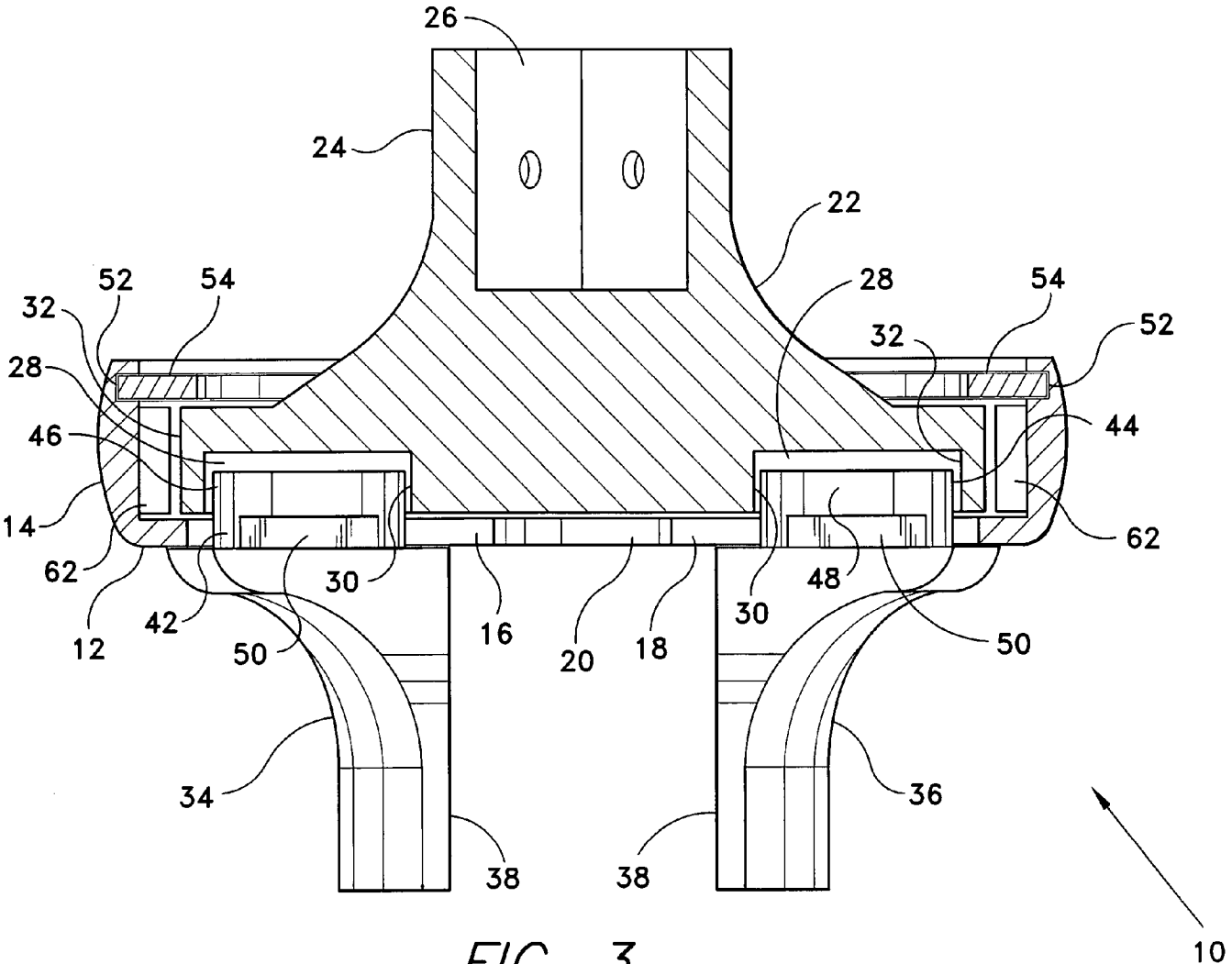
FIG. 3 is s side elevation view in partial section of the gripping device, showing further details thereof.

The present invention comprises several embodiments of an automatically adjusting gripping device having jaws which automatically adjust the span therebetween to grip or release a workpiece as torque is applied to the device. FIG. 1 provides an illustration of the device 10 in use as an adjustable wrench having torque applied thereto by a conventional ratchet, with FIGS. 2 and 3 illustrating the various components and their operation.

The gripping device 10 includes a generally circular base plate 12 having a circumferential wall 14 surrounding the plate 12. The plate 12 includes a series of linear jaw guide slots 16 and 18 radiating from a central jaw head installation passage 20. The passage 20 has a diameter larger than the width of the slots 16 and 18, as is clearly shown in FIG. 2. While the jaw slots 16 and 18 appear to form a single, continuous slot in the two jaw embodiment of FIGS. 1 through 3, they are actually two separate slots disposed directly opposite one another, to provide for two directly opposed jaws to operate therein.

A generally circular torque application component 22 is installed immediately adjacent the base plate 12 and within the base plate wall 14, and rotates within the base plate wall 14 (within the limits due to the other components of the assembly, discussed further below). The torque component 22 may be adapted for use with a ratchet R (shown in FIG. 1), square drive extension, torque wrench, or other similar device, having a boss 24 extending therefrom with a square drive receptacle 26 within the boss 24. Alternatively, the torque component 22 may include some other means of receiving torque applied thereto, e.g., external teeth disposed upon the boss 24, which are periodically engaged by a gear or rack; a lever; or other means of rotating the torque component 22 relative to the base plate 12 could be employed. Such a mechanism would permit the present gripping device 10 (or other embodiments thereof) to be installed upon or adjacent to a conveyor line or similar environment, for periodically gripping and releasing articles along the line.

Figure 4:
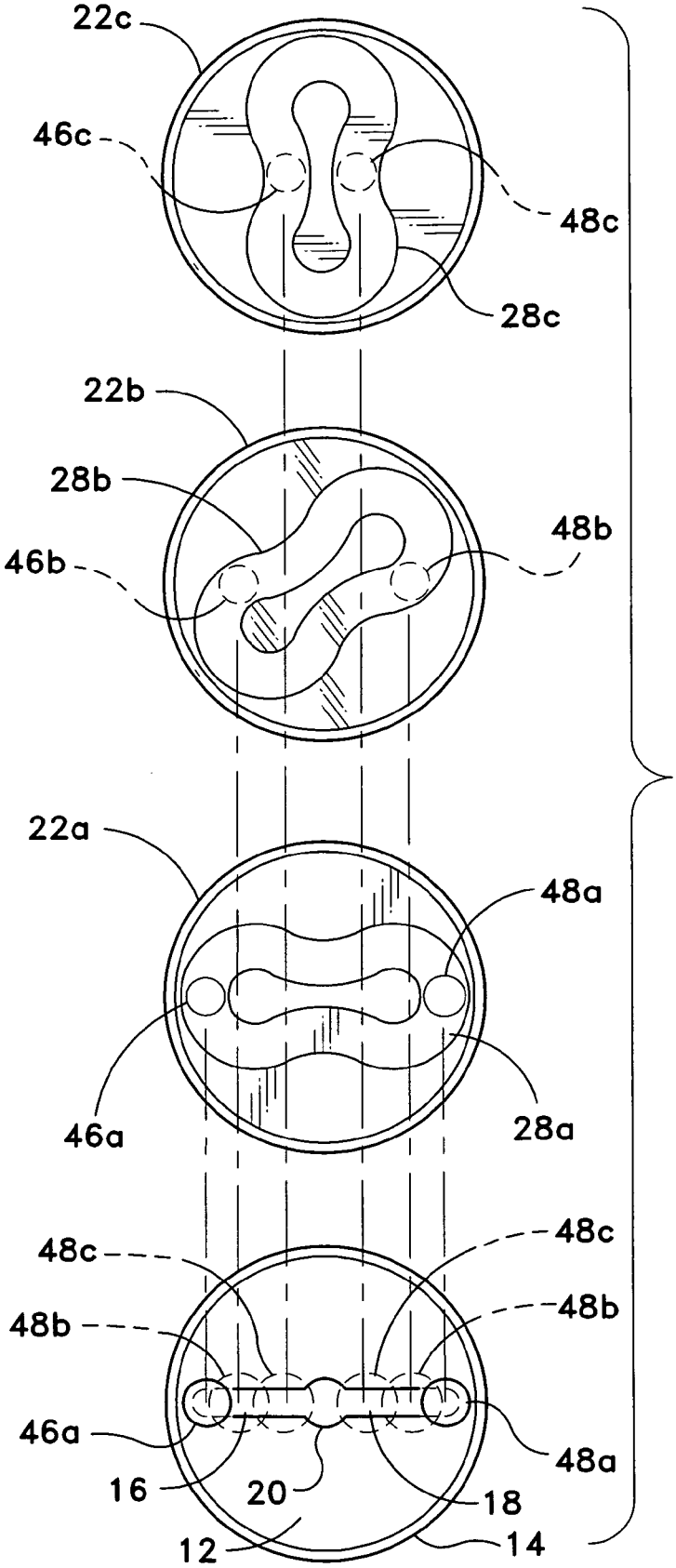
FIG. 4 is a diagrammatic plan view of the base plate and the torque application component in various degrees of rotation, showing the adjustment of the jaws within the guide slot by the relative rotation of the cam track.

In the embodiment shown in FIGS. 1–4, the torque component 22 includes cam track 28 formed therein shaped generally as a figure eight, most clearly shown in the sequence of views showing the operation of the device in FIG. 4. The cam track 28 comprises a channel defined by inner and outer walls 30 and 32, with the variable diameter of the track 28 and channel 32 serving to vary the spacing between the jaws of the device as the torque application component 22 rotates relative to the base plate 12. The operation is described in greater detail further below. Also, while the figure eight track or channel 32 shape provides a wide range of adjustment for the two jaw embodiment of FIGS. 1 through 4, innumerable other track or channel configurations are possible with the present invention, with a few exemplary alternative configurations illustrated in FIGS. 5A, 5B, 7, 8, and 9, and discussed further below.

A pair of adjustably positionable gripping jaws 34 and 36 extend from the base plate 12, and serve to grip a workpiece W, e.g., a hexagonal bolt head (FIG. 1), nut, or other article that the shape of the jaws 34 and 36 configured to grip. In the embodiment shown in FIG. 2, each of the jaws 34 and 36 has a jaw body 38 having a pair of angularly facing workpiece-gripping faces 40 that define an interior angle therebetween. The interior angle may be 120° for use with hexagonal fittings or workpieces, or 90° for use with square headed workpieces, or some other angle as desired. While the jaw bodies 38 are shown disposed to the inward sides or areas of the jaws, it will be seen that the jaw bodies 38 could be formed with greater separation therebetween, if so desired. This would position the jaw bodies 38 relatively close to (or even beyond) the outer diameter of the base plate 12, thus providing the greatest potential span for the jaw bodies 38.

Each jaw 34 and 36 also includes a cylindrical head, 42 and 44, respectively, extending therefrom, with each head 42, 44 having a circular cam track engagement portion, respectively 46 and 48, which rides within the cam track or channel 28. Each jaw head 42, 44 also includes a neck having a pair of opposed parallel flats 50 between the cam track engagement portions 46 and 48 of the jaw heads 42 and 44 and their respective jaw bodies 38. The opposed flats 50 on each jaw neck are spaced apart to have very nearly the same span therebetween as the width of the guide slots 16 and 18 of the base plate 12, and are captured and slide within their respective slots 16 and 18. The nearly identical span between the flats 50 on each jaw head 42, 44 compared to the width of its respective slot 16 and 18, precludes rotation of the jaw heads 42, 44 and jaws 34, 36 within their respective slots 16 and 18, thus assuring that the jaws 34 and 36 always face one another to grip a workpiece or other article therebetween.

FIG. 4 provides an illustration of a series of three different torque application component orientations, and corresponding cam track or channel orientations, relative to the base plate 12 with its jaw slots 16 and 18 and the jaw heads sliding therein. The three different torque component orientations are designated as 22*a*, 22*b*, and 22*c*, with their corresponding cam track or channel orientations designated as 28*a*, 28*b*, and 28*c*. It will be seen that the torque components 22*a*, 22*b*, and 22*c* are identical to one another, with the only difference between these components being their orientations or angular rotation relative to the base plate 12.

In FIG. 4, torque component 22*a* is oriented with the major axis of the figure eight shaped cam track or channel 28*a* oriented horizontally. With the horizontal orientation of the two slots 16 and 18 in the base plate 12, this orientation would place the heads 46*a* and 48*a* (shown in solid lines, in agreement with the solid line positions of these components 46*a* and 48*a* relative to their slots 16 and 18 in the base plate 12) of their respective jaws at the ends of the major axis of the cam track 28*a*, thus spreading the jaws to their maximum spacing in the slots 16 and 18 of the base plate 12.

The next higher position of the torque application component in FIG. 4, designated as torque component 22*b*, is turned approximately 45° counterclockwise from the orientation of the torque component 22*a*. This rotates the cam track or channel 28*b* so that the portions horizontally opposite one another, i.e., those portions lying over the slots 16 and 18 of the base plate 12 when the components are assembled, have a somewhat smaller span therebetween than the major axis of the cam track. As the jaws are restricted to purely linear or horizontal travel in the illustrations in FIG. 4 due to the fixed horizontal orientation of the guide slots 16 and 18 in the base plate 12, the jaw heads must travel about the figure eight shaped cam track 28*b* to the locations shown in the torque component 22*b* as it rotates, thus moving the jaw heads 46*b* and 48*b* (shown in broken lines) closer to one another due to the smaller horizontal span or diameter across the cam track 28*b* in this orientation. The result is that the two jaws are drawn more closely together as the torque application component is rotated from its 22*a* orientation to its 22*b* orientation, relative to the fixed base plate 12 in FIG. 4.

In the uppermost torque component position of FIG. 4, designated as 22*c*, the component has been turned another 45° counterclockwise to orient the major diameter of the cam track 28*b* vertically and its minor diameter horizontally. The critical portion of the cam track governing the adjustment of the jaws, i.e., the portion of the cam track lying over the horizontally disposed guide slots 16 and 18 of the base plate 12, is its narrowest or minor diameter in the orientation of the torque component 28*c*. Thus, the two jaw heads 46*c* and 48*c* are pushed closer together as they slide relative to the rotation of the cam track 28*c*, until they reach their closest relative positions as shown in the uppermost orientation of the torque component 28*c* and corresponding positions 46*c* and 48*c* (in broken lines) in the base plate 12 in FIG. 4.

Figure 5A:
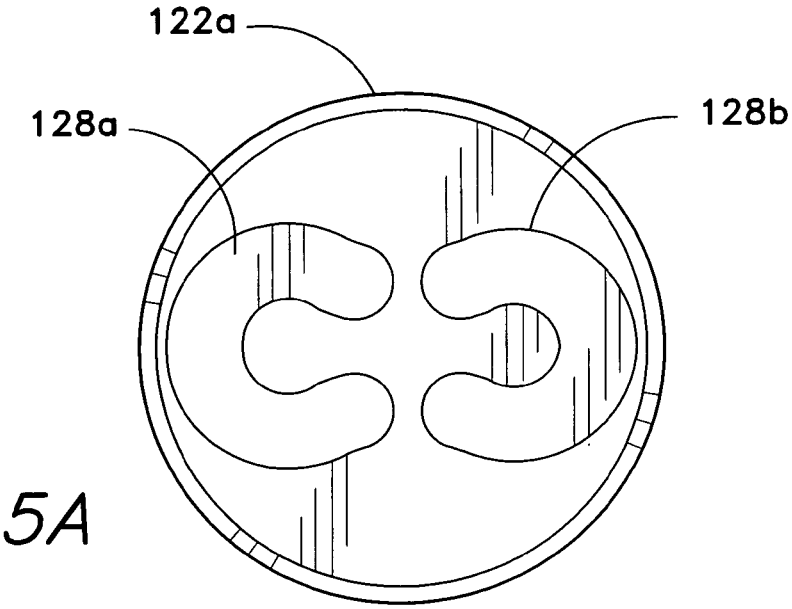
FIG. 5A is a plan view of an alternative, segmented cam track configuration according to the present invention.
Figure 5B:
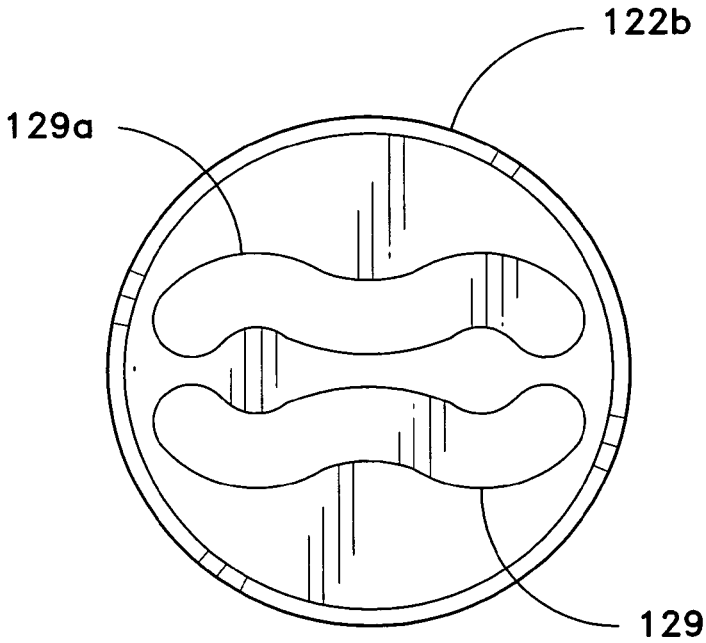
FIG. 5B is a plan view of another alternative, segmented cam track configuration according to the present invention.

To this point, the cam track of the embodiment 10 of FIGS. 1 through 4 has been shown and described as a single, continuous loop, enabling the torque component 22 to be rotated endlessly to space the two jaws 34 and 36 relative to one another, so long as there is nothing placed between the jaws to limit their approach to one another. However, the cam track or channel may be divided into separate, oppositely symmetrical segments for each jaw, if so desired. Examples of such cam track configurations are illustrated in FIGS. 5A and 5B, with the corresponding torque application components respectively designated as 122*a* and 122*b*. The cam track or channel components 128*a* and 128*b* of the torque component 122*a* are separated across the minor axis of the figure eight pattern formed by the two segments when combined together, while the cam track components 129*a* and 129*b* of the torque component 122*b* are separated across the major axis of the figure eight pattern. It will be seen that the travel of the jaw heads in these various segmented track patterns is essentially the same as that shown in FIG. 4 and described further above, except that the travel is limited to slightly less than 180° of relative rotation, and must be reversed to reverse the direction of travel of the jaws in the corresponding base plate slots.

The various components comprising the various embodiments of the present gripping device may be assembled using a variety of principles. Returning to FIGS. 2 and 3, it will be noted that the internal upper edge of the base plate wall 14 has a retaining ring slot 52 formed therein, with an internal retaining ring (snap ring) 54 installed within the slot 52 over the outer periphery of the torque component 22 to retain the torque component 22 against the base plate 12.

Figure 6A:
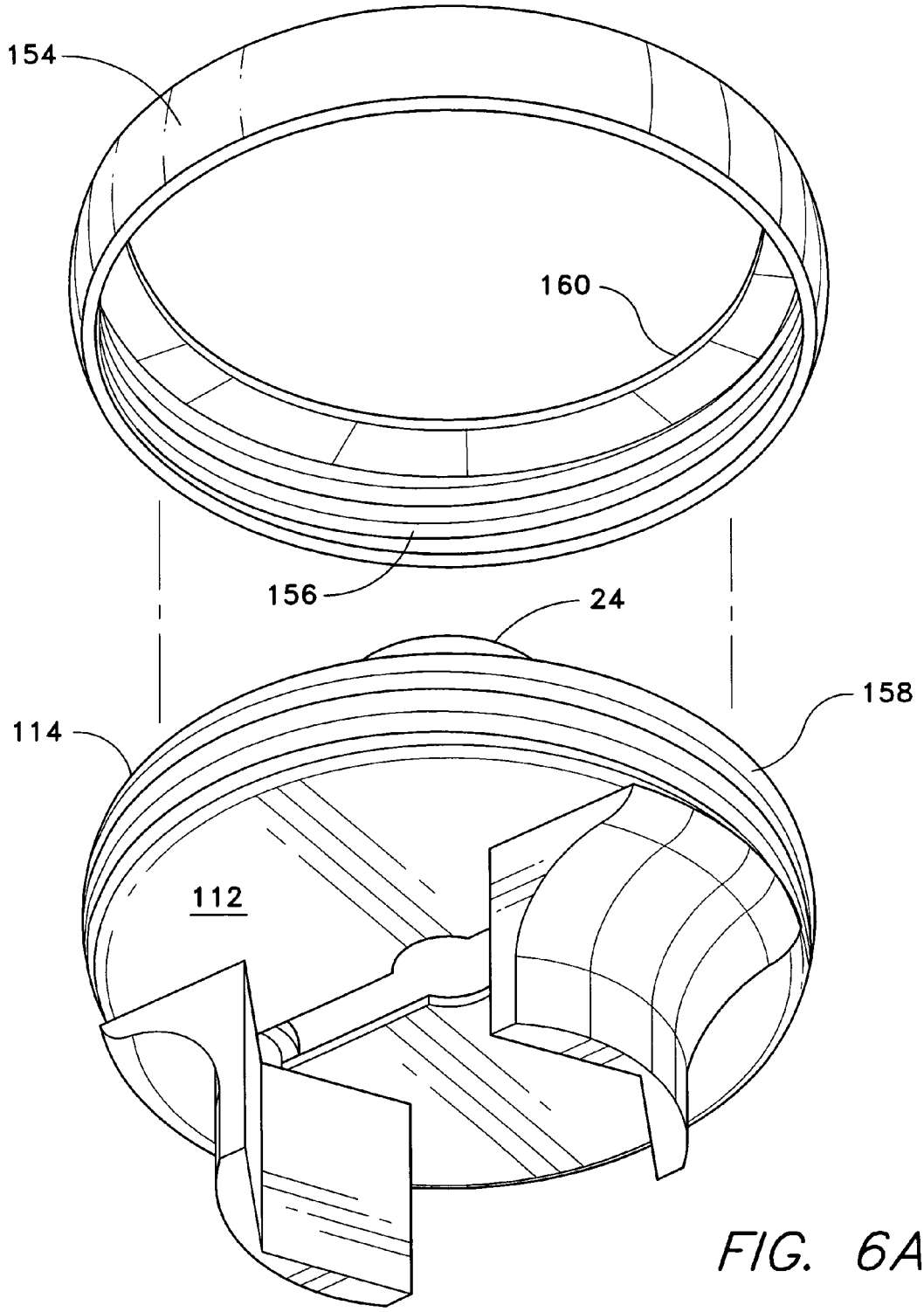
FIG. 6A is an exploded perspective view of an alternative embodiment of a gripping device according to the present invention, having a threaded attachment ring securing the two major components.
Figure 6B:
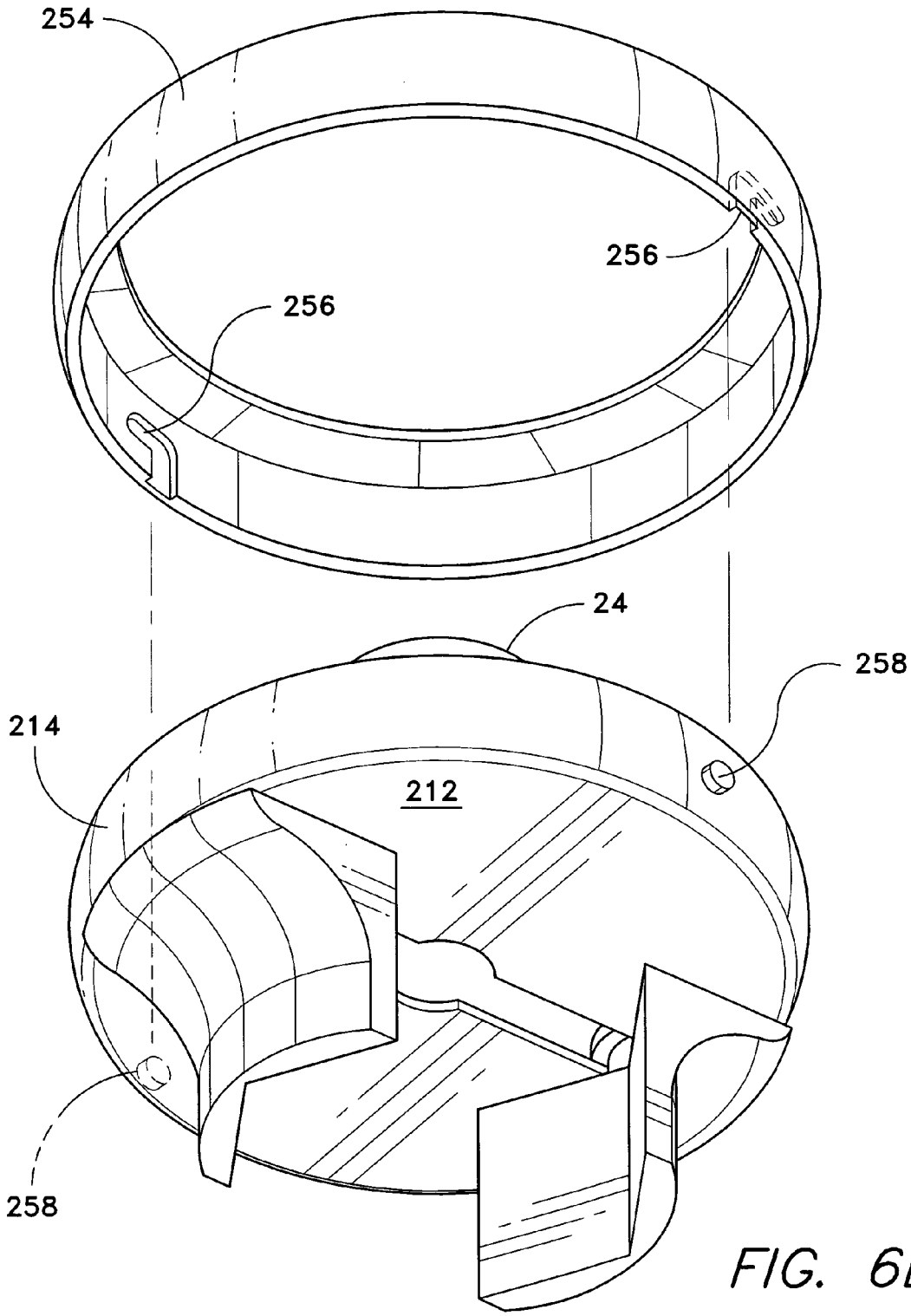
FIG. 6B is an exploded perspective view of an alternative embodiment of a gripping device according to the present invention having a pin and slot, or bayonet-type attachment, between the two major components.

FIGS. 6A and 6B illustrate different means of securing the torque application component within the walls of the base plate. In FIG. 6A, a retaining ring 154 includes a threaded inner periphery 156 which mates with the external threads 158 disposed upon the wall 114 of the base plate 112. The retaining ring 154 also includes an inwardly extending flange 160 which extends over the outer periphery of the torque application component disposed within the wall 114 and over the base plate 112; the top of the drive boss 24 of the torque component is just visible in FIG. 6A.

FIG. 6B illustrates a retainer ring with a bayonet connector rotationally securing the torque application component to the base plate. In FIG. 6B, the retaining ring 254 includes a pair of opposed, generally L-shaped internal slots 256, which engage a corresponding pair of opposed pins 258 extending outwardly from the wall 214 of the base plate 212. The torque application component (the drive boss 24 of which is just visible in FIG. 6B) is placed upon the base plate 212 and within its wall 214. The retaining ring 254 is installed over the outer edge or surface of the base plate wall 214 and turned slightly to lock the base plate wall pins 258 within the circumferentially oriented portions of the slots 256. Additional slots and pins may be provided as desired in the above assembly.

Alternatively, the upper edges of the base plate wall could be peened or staked inwardly to overly the periphery of the torque application component, or small retaining screws or the like could be driven into the upper, inner edge of the base plate wall, or the retaining ring could be welded, brazed, or soldered in place, etc.

To this point, the various embodiments described have included two mutually opposed jaws slidably retained within their two corresponding opposed slots in the base plate. Such a two jaw configuration requires that the cam track of the assembly have only two lobes, whether formed as a continuous, closed loop or as a plurality of cam track segments, as shown in FIGS. 5A and 5B. However, it will be seen that the present gripping device could be constructed to have more than two jaws, if so desired.

Figure 7:
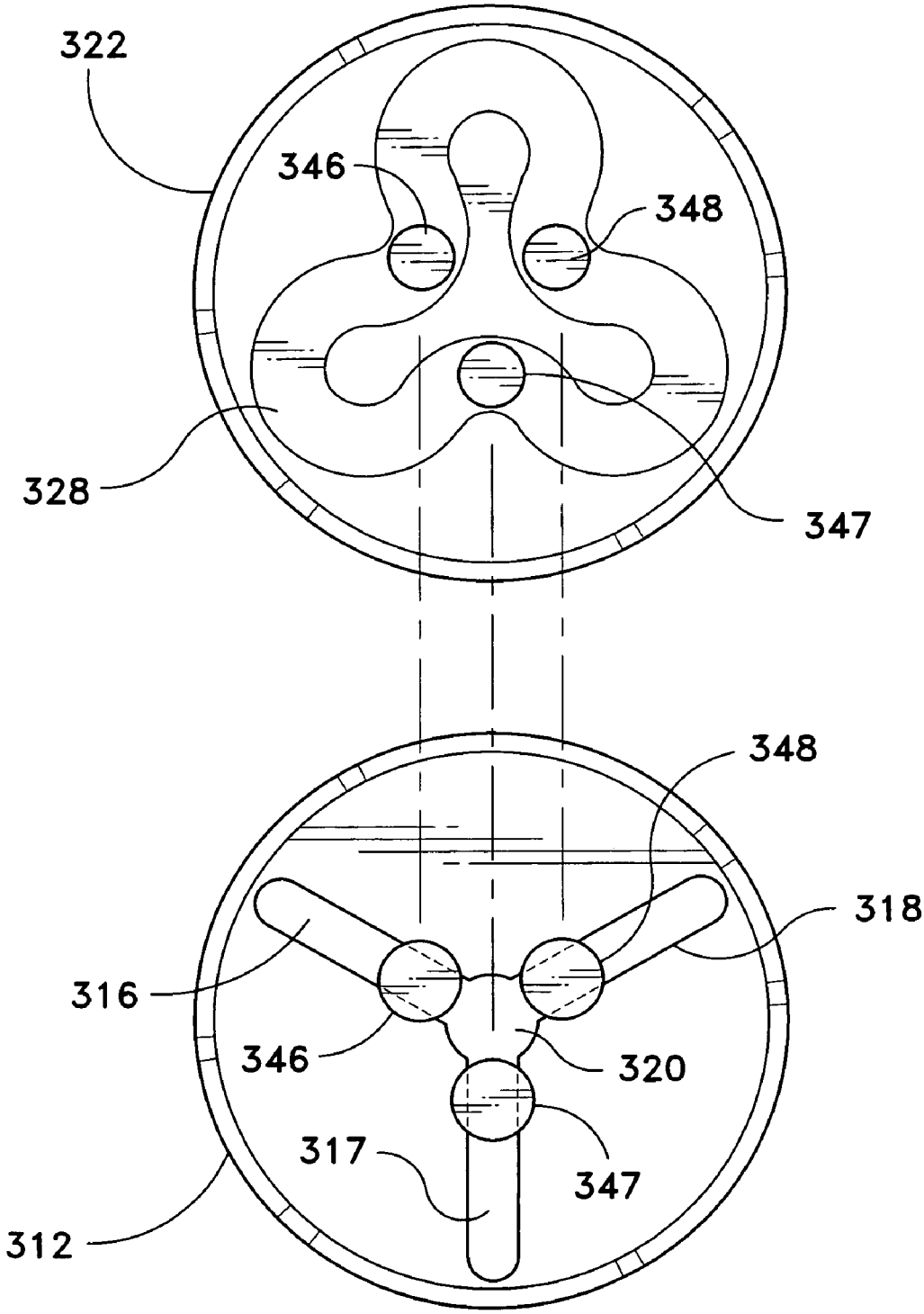
FIG. 7 is a diagrammatic plan view of the base plate and torque application component of an alternative configuration having three jaws with three slot segments and a three lobed cam track, exploded to show relative positions of the jaws.

FIG. 7 provides a schematic illustration of a three-jaw embodiment of the present invention. In FIG. 7, the base plate 312 includes a central jaw head installation passage 320 with a series of three equiangularly spaced jaw slots 316, 317, and 318 radiating from the central passage 320. A series of jaw heads 346, 347, and 348 are shown riding in their respective slots 316 through 318 in the base plate 312. These jaw heads 346 through 348 are also shown in their corresponding positions in the three-lobed continuous cam track 328, formed within the torque application component 322 of FIG. 7.

A comparison of FIG. 7 to FIG. 4, which shows the operation of a two jaw embodiment with a figure eight shaped cam track having two lobes, will show that rotation of the torque application component 322 relative to the base plate 312 will result in the jaw heads 346 through 348 traveling along the path defined by the cam track 328 due to the limiting of their movement by the base plate slots 316 through 318. This causes the jaw heads 346 through 348 to slide radially inwardly and outwardly along their corresponding base plate slots 316 through 318, in a manner analogous to that of the operation of the two-jaw embodiment shown in FIG. 4 and described in detail further above. It will be seen that the three-lobed, trefoil-shaped cam track of the embodiment of FIG. 7 may be divided into a series of three separate segments in order to preclude continuous rotation of the base plate 312 and torque application components 322, relative to one another, if so desired. It will also be noted that the cam track is symmetrical about an axis bisecting any one of the three lobes.

Figure 8:
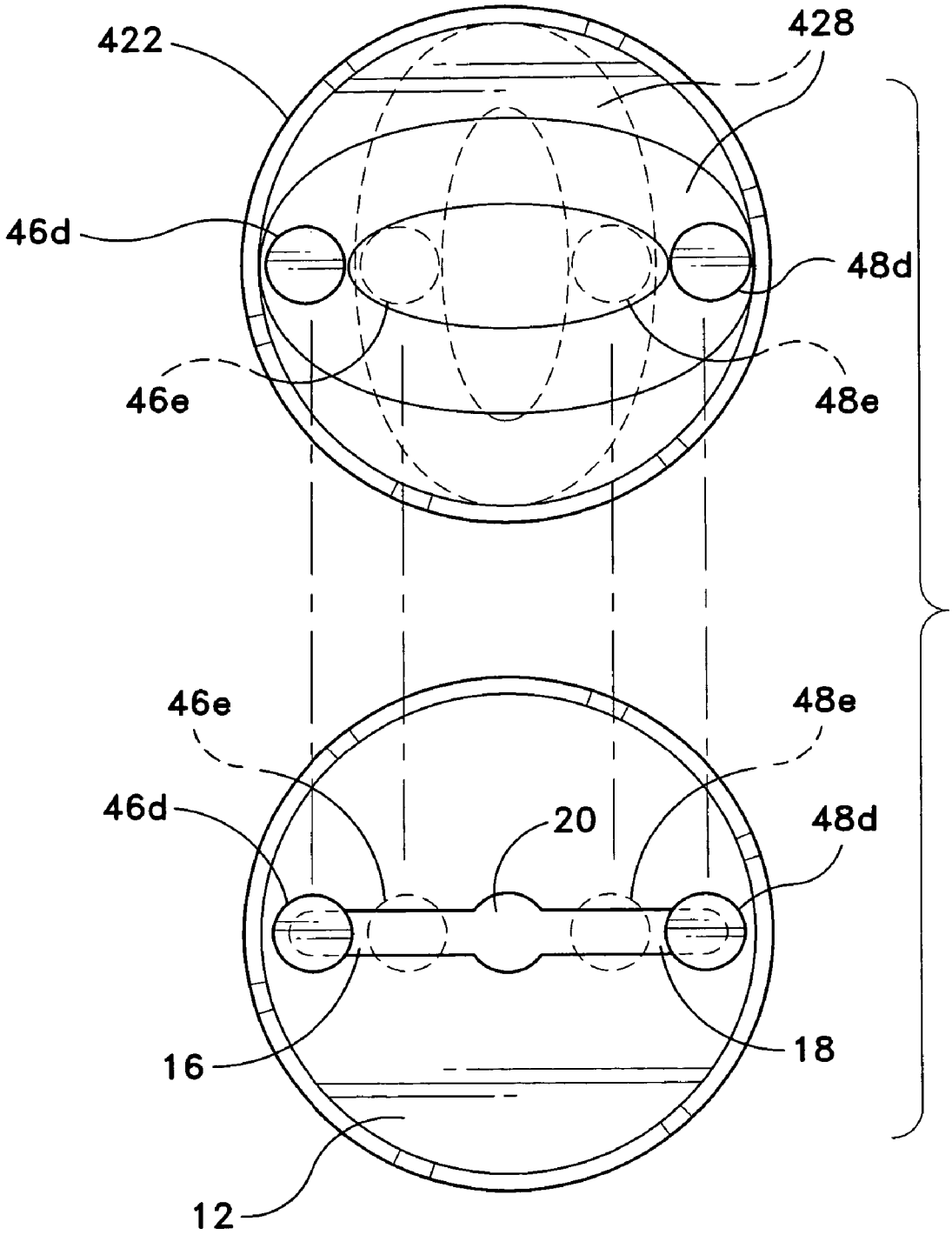
FIG. 8 is a diagrammatic plan view of a base plate and a torque application component according to the present invention having an alternative elliptical cam track configuration, exploded to show adjustment of the two jaws in the slot due to relative rotation of the elliptical cam track.

FIG. 8 provides a schematic illustration of the operation of yet another embodiment of the present gripping device. The embodiment of FIG. 8 includes only two jaws and functions in much the same manner as that described further above in the discussion of FIG. 4. The base plate 12 with its two opposed slots 16, 18 and central jaw head installation passage 20 may be identical to the embodiment of FIGS. 1 through 4, or may incorporate any of the base plate to torque component attachment means illustrated in FIGS. 6A and 6B and discussed further above. The difference between the embodiment of FIG. 8 and that of FIGS. 1 through 4 is that the torque component 422 contains a cam track 428 having a different shape than the cam track 28 of the embodiment of FIGS. 1 through 4. In FIG. 8, the cam track 428 has an elliptical shape, rather than the figure eight shape of the embodiment of FIGS. 1 through 4.

When the major axis of the elliptical cam track 428 is parallel to the span of the two slots 16 and 18 of the base plate 12, the two jaw heads 46*d* and 48*d* are disposed at the extreme outer ends of the slots, as shown by the solid line showing of the jaw heads 46*d* and 48*d* in FIG. 7. However, rotation of the torque component 422 relative to the base plate 12 to turn the elliptical cam track 428 so that its minor axis lies along the two slots 16 and 18, as shown in broken lines in FIG. 8, results in the two jaw heads moving inwardly along the jaw slots 16 and 18 to the positions shown in broken lines at 46*e* and 48*e* in FIG. 8. It will be noted that the relative movement of the jaw heads is less when an elliptical cam track is provided, than with the figure eight cam track illustrated in FIG. 4. Generally, a cam track providing a greater adjustment range for the jaw heads is more desirable. However, the cam track may be formed with any practicable shape, as desired, either as a single, continuous loop, or as a plurality of segments.

Figure 9:
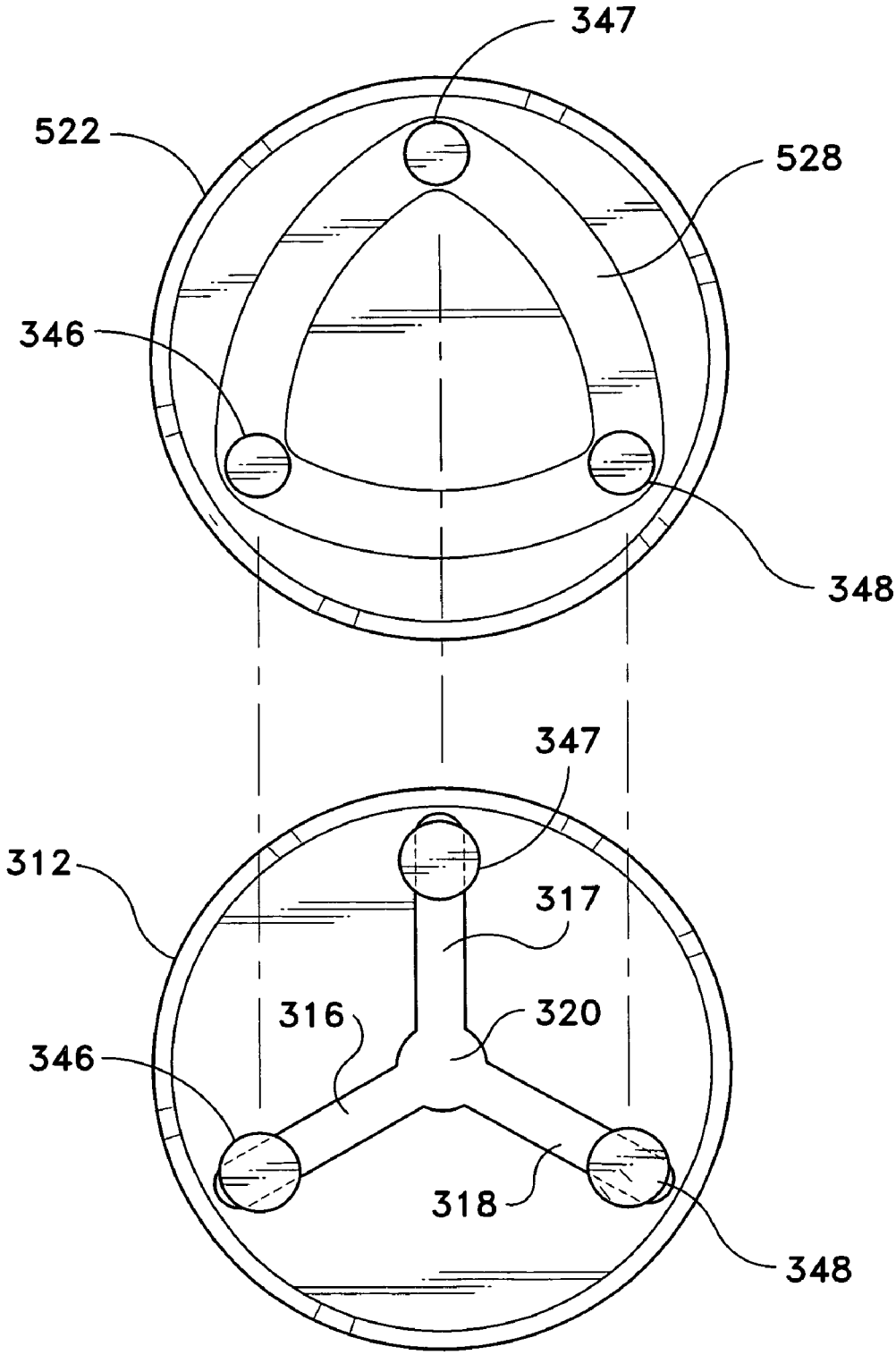
FIG. 9 is a diagrammatic plan view of a base plate and torque application component according to the present invention with another alternative configuration having three jaws, the cam track having a generally triangular configuration with three arcuate sides.

FIG. 9 provides an illustration of yet another embodiment having a three-jaw arrangement. It will be seen that the base plate 312 of FIG. 9, with its three equiangularly spaced slots 316, 317, and 318 and central passage 320, is identical to the three slotted base plate embodiment of FIG. 7. However, the corresponding torque component 522 differs due to the different shape of its cam track 528. Rather than having a trefoil shape, as in the three-lobed cam track 328 of the embodiment of FIG. 7, the cam track 528 of the embodiment of FIG. 9 forms a triangular shape with the three sides being arcuately convex. It will be seen that the jaw travel provided by such a cam track shape is somewhat less than that provided by the trefoil shaped cam track 328 shown in FIG. 7, but as in the case of the various two jaw embodiments, the cam track of the three jaw embodiments may be configured as desired. It will also be noted that the cam track 528 is symmetrical about an axis passing through any one of the vertices and the midpoint of the base opposite the vertex.

The operation of the gripping device in its various embodiments is essentially automatic when torque is applied to the torque application component of the assembly. In the exemplary explanation below, the device will be considered as a wrench. However, it will be seen that the gripping device may be used in other fields as well, e.g., as an automatic device for gripping and releasing an article in a conveyor system, as noted further above. Assuming a bolt or other threaded fastener is to be tightened, the mechanic need only install a ratchet R (or other torque producing device) on the drive boss 24, generally as shown in FIG. 1, and turn the assembly in the desired direction. Left hand or right hand thread direction is of no concern (so long as the ratchet R has been set for proper rotation), as the gripping device will close upon and grip the fastener as it is rotated in either direction, particularly for those embodiments having single, continuous loop cam tracks.

As the ratchet R (or other torque device) is rotated, the jaws will be forced along their corresponding slots in the base plate due to the rotation of the torque application plate relative to the base plate. Eventually, after some fraction of a full rotation, the jaws will slide inwardly to the point that they contact the faces of the fastener. As no further jaw motion is possible relative to the base plate slots at this point, motion between the torque component and base plate will also be locked, allowing all torque applied to the ratchet R to be applied through the torque component, its jaw heads, and the base plate to the jaws and the fastener gripped therein. The greater the torque applied to the wrench, the more the jaws are forced toward one another and the tighter they grip the workpiece captured therebetween.

It will be seen that reversal of the direction of the applied force on the ratchet R will also release the lockup of the components in the gripping device. This may even cause the jaws of the gripping device to open relative to the fastener, as the drag of the ratcheting mechanism tends to rotate the drive in the opposite direction as the ratchet handle is rotated in that direction. Accordingly, a mechanism for resisting relative rotation between the torque component and the base plate may be provided. FIG. 2 illustrates this mechanism, wherein the inner surface of the base plate wall 14 has a continuous circumferentially disposed series of teeth 62 or other irregularities thereon. At least one (two are shown in FIG. 2) outwardly biased detent pin 64, or tooth, finger, or similar component, is installed in a radially disposed receptacle 66 formed in the side of the torque application plate 22. A spring 68 may be provided to urge the pin 64 outwardly to engage the teeth 62 of the base plate wall 14. The coarseness of the teeth 62, the sharpness of the pin 64, and/or the pressure of the spring 68, may be adjusted as required to produce sufficient drag or resistance to rotation to prevent the torque component 22 from rotating relative to the base plate 12 as the ratchet R is rotated in its release direction. Thus, the relative positions of the torque component 22 and base plate 12 will remain as they were before release of the torque on the ratchet to provide continuous grip to the fastener or workpiece W, allowing the mechanic to swing the ratchet R back in the original direction to turn the fastener or workpiece without needing to hold the positions of the base plate 12 and torque component 22 in place.

When it is desired to turn the fastener in the opposite direction, the mechanic need only switch the ratcheting direction of the ratchet R using the conventional control provided, and rotate the ratchet handle arcuately back and forth. Locking of the ratchet R in the opposite direction will override the resistance to relative rotation provided by the teeth 62 and pin(s) 64 of the base plate 12 and torque component 22, thereby allowing the two components to rotate relative to one another in the opposite direction. This will move the jaws apart from one another, but continued relative rotation of the two components 12 and 22 will cause the jaws to begin to move toward one another again, eventually locking onto the fastener head for rotation thereof. Operation of the device continues as described further above, but with driving and ratcheting being in the opposite direction.

In conclusion, the automatically adjusting gripping device in its various embodiments, greatly simplifies the assortment of tools required by the typical mechanic or other person who has need to remove and install threaded fasteners from time to time. A person using the gripping device no longer has need of myriad different sockets in both metric and English sizes. The gripping device provides infinitesimal adjustment between positions, thereby allowing the device to grip any size fitting between its maximum and minimum spans. The cam track configuration of the adjustment mechanism results in an ever tighter grip upon the workpiece as torque is increased to the torque application component, which feature is not present in conventional sockets and the like. The ever tightening function of the present device as ever greater torque is applied thereto, results in a greatly reduced tendency to "round off" the corners of a bolt, nut, or other fastener head during installation or removal thereof.

While the above example and the drawing of FIG. 1 show and describe the present device as a wrench attachment for use in driving and removing threaded fasteners, it has been noted that the usage of the present device may extend to other fields as well. As noted further above, the device may be installed upon or adjacent to a conveyor line, where with proper rotary actuation to open and close the jaws, it may be used to grasp and release articles along or adjacent to the conveyor line. The device may be adapted to other operating environments as well, for use anywhere the selective gripping of a workpiece or other article is required.

It is to be understood that the present invention is not limited to the embodiments described above, but encompasses any and all embodiments within the scope of the following claims.

I claim:

1. An automatically adjusting gripping device, comprising:

a base plate having at least one linear guide slot defined therein;

a torque application component rotationally attached to the base plate, the component having an upper surface adapted for attachment to a rotary drive mechanism and a lower surface having at least one cam track defined therein, the lower surface facing the base plate and the cam track being symmetrical about an axis parallel to the at least one guide slot, wherein said at least one cam track comprises a single, continuous, closed loop forming a figure eight shape; and a pair of jaws depending from the guide slot, each of the jaws having:

a jaw body having a workpiece gripping face;

a neck extending from the body, the neck being slidably disposed in the guide slot; and a head attached to the neck, the head being slidably disposed in the cam track channel and retained between the torque application component and the base plate, the workpiece gripping face of the pair of jaws facing each other;

wherein rotation of the torque application component relative to the base plate slides the heads of the jaws along the cam track to vary the spacing between the jaws, the jaws being constrained to linear movement towards and away from each other by movement of the neck in the guide slot to grip and release the workpiece therebetween.

2. The gripping device according to claim 1, wherein the at least one cam track comprises a plurality of separate, oppositely symmetrical segments.

3. The gripping device according to claim 1, wherein said base plate further comprise a peripheral wall, the gripping device further including:

a plurality of teeth disposed inwardly about the circumferential wall of said base plate; and at least one resiliently biased detent pin extending radially from said torque application component, engaging the teeth of the wall of said base plate and resisting free rotation of said torque application component relative to said base plate.

4. The gripping device according to claim 1, wherein:

said base plate has a central jaw head insertion passage defined therein;

the at least one guide slot comprises two mutually opposed, guide slots extending radially from the jaw head insertion passage;

said pair of jaws comprise a single jaw disposed in each of the jaw slots; and the at least one cam track includes two cam track lobes, with a single jaw head residing in each of the lobes.

5. The gripping device according to claim 1, wherein:

said base plate includes a central jaw head insertion passage;

the plurality of jaw slots comprises three equiangularly spaced, radially disposed jaw slots extending from the jaw head insertion passage;

said plurality of jaws comprise a single jaw disposed in each of the jaw slots; and the at least one cam track includes three cam track lobes, with a single jaw head residing in each of the lobes.

6. An automatically adjusting gripping device, comprising:

a generally circular base plate including a plurality of radially disposed jaw slots therethrough;

a circumferential wall disposed about said base plate;

a generally circular torque application component rotationally disposed adjacent said base plate and within the wall thereof;

at least one laterally symmetrical cam track having a variable diameter disposed within said torque application component, the cam track having an inner wall and an outer wall defining a channel therebetween;

a plurality of jaws corresponding in number to the plurality of jaw slots of said base plate and extending therefrom, each of said jaws having at least;

a jaw body having a pair of workpiece gripping faces defining an interior angle therebetween;

a circular cam track engagement head extending from the jaw body, slidingly riding within the cam track of said torque application component and in opposition to one another;

a pair of opposed, parallel flats disposed between the cam track engagement portion of the head and the jaw body, captured and slidingly riding within a corresponding one of the slots of said base plate and precluding rotation of said jaw relative to the slot; whereby rotation of said torque application component relative to said base plate, slides the cam track engagement heads of said jaws along the at least one cam track of said torque application component to vary the spacing between said jaws in accordance with the variable diameter of the at least one cam track as said jaws travel symmetrically along their corresponding slots within said base plate.

7. The gripping device according to claim 6, wherein the at least one cam track comprises a single, continuous, closed loop.

8. The gripping device according to claim 6, wherein the at least one cam track comprises plural, separate, oppositely symmetrical segments.

9. The gripping device according to claim 6, further including:

a plurality of teeth disposed inwardly about the circumferential wall of said base plate; and at least one resiliently biased detent pin extending radially from said torque application component, engaging the teeth of the wall of said base plate and resisting free rotation of said torque application component relative to said base plate.

10. The gripping device according to claim 6, wherein:

said base plate includes a central jaw head insertion passage;

the plurality of jaw slots comprises two mutually opposed, radially disposed jaw slots extending from the jaw head insertion passage;

said plurality of jaws comprise a single jaw disposed in each of the jaw slots; and the at least one cam track includes two cam track lobes, with a single jaw head residing in each of the lobes.

11. The gripping device according to claim 6, wherein:

said base plate includes a central jaw head insertion passage;

the plurality of jaw slots comprises three equiangularly spaced, radially disposed jaw slots extending from the jaw head insertion passage;

said plurality of jaws comprise a single jaw disposed in each of the jaw slots; and the at least one cam track includes three cam track lobes, with a single jaw head residing in each of the lobes.

12. An automatically adjusting gripping device, comprising:

a generally circular base plate including a plurality of radially disposed jaw slots therethrough, each of the slots having a narrow width and a central jaw head insertion passage having a diameter greater than the widths of the jaw slots;

a circumferential wall disposed about said base plate;

a generally circular torque application component rotationally disposed adjacent said base plate and within the wall thereof;

at least one cam track having a variable diameter disposed within said torque application component, the cam track having an inner wall and an outer wall defining a channel therebetween;

a plurality of jaws corresponding in number to the plurality of jaw slots of said base plate and extending therefrom, each of said jaws having at least;

a jaw body having a pair of workpiece gripping faces defining an interior angle therebetween;

a circular cam track engagement head extending from the jaw body, having a diameter adapted for installing through the central jaw head insertion passage and slidingly riding within the cam track of said torque application component and in opposition to one another; whereby rotation of said torque application component relative to said base plate, slides the heads of said jaws along the at least one cam track of said torque application component to vary the spacing between said jaws in accordance with the variable diameter of the at least one cam track as said jaws travel along their corresponding slots within said base plate.

13. The gripping device according to claim 12, wherein each of said jaws further includes a pair of opposed, parallel flats disposed between the cam track engagement portion of the head and the jaw body, captured and slidingly riding within a corresponding one of the slots of said base plate and precluding rotation of said jaw relative to the slot.

14. The gripping device according to claim 12, wherein the at least one cam track comprises a single, continuous, closed loop.

15. The gripping device according to claim 12, wherein the at least one cam track comprises plural, separate, oppositely symmetrical segments.

16. The gripping device according to claim 12, further including:

a plurality of teeth disposed inwardly about the circumferential wall of said base plate; and at least one resiliently biased detent pin extending radially from said torque application component, engaging the teeth of the wall of said base plate and resisting free rotation of said torque application component relative to said base plate.

17. The gripping device according to claim 12, wherein:

the plurality of jaw slots comprises two mutually opposed, radially disposed jaw slots extending from the jaw head insertion passage;

said plurality of jaws comprise a single jaw disposed in each of the jaw slots; and the at least one cam track includes two cam track lobes, with a single jaw head residing in each of the lobes.

18. The gripping device according to claim 12, wherein:

the plurality of jaw slots comprises three equiangularly spaced, radially disposed jaw slots extending from the jaw head insertion passage;

said plurality of jaws comprise a single jaw disposed in each of the jaw slots; and the at least one cam track includes three cam track lobes, with a single jaw head residing in each of the lobes.

* * * * *